United States Patent [19]

Brut et al.

[11] 3,962,064

[45] June 8, 1976

[54] ELECTROLYZER AND A METHOD FOR THE PRODUCTION OF READILY OXYDIZABLE METALS IN A STATE OF HIGH PURITY

[75] Inventors: Albert Brut, Bollene; Gérard Nave, Miramas; Jean-Pierre Deleuil, Salon; Jean-Claude Brun, Miramas; Yves Martin, Bordeaux-Cauderan, all of France

[73] Assignee: Commissariat a l'Energie Atomique, Paris, France

[22] Filed: Sept. 13, 1974

[21] Appl. No.: 503,928

[52] U.S. Cl. ..... 204/245; 204/68; 204/243 R; 204/246; 204/247

[51] Int. Cl.[2] ..... C25C 1/02; C25C 7/08

[58] Field of Search ..... 204/68–70, 204/243 R, 245, 246, 247

[56] References Cited

UNITED STATES PATENTS

| | | | |
|---|---|---|---|
| 2,382,434 | 8/1945 | McNitt | 75/93 |
| 2,390,114 | 12/1945 | McNitt | 204/68 |
| 2,944,950 | 7/1960 | Hayes | 204/68 |
| 3,037,927 | 6/1962 | Gallinger | 204/245 |
| 3,396,094 | 8/1968 | Sivilotti et al. | 204/247 X |

*Primary Examiner*—F.C. Edmundson

*Attorney, Agent, or Firm*—Cameron, Kerkam, Sutton, Stowell & Stowell

[57] ABSTRACT

A readily oxidizable metal such as lithium formed along a cathode is collected in an electrolytic tank within a collecting chamber, the level of electrolyte is caused to rise to a predetermined top level at which the lithium leaves the collecting chamber and overflows into a transfer compartment, the level of electrolyte is lowered to a predetermined bottom level at which the poured-off lithium leaves the transfer compartment and passes to the discharge compartment, the level of electrolyte is raised to the top level in order to ensure overflow into a discharge tube. A stream of inert gas is passed into the discharge compartment and the lithium is transferred to a chamber for treatment in an inert atmosphere and conversion to ingots in the pure state.

5 Claims, 3 Drawing Figures

ELECTROLYZER AND A METHOD FOR THE PRODUCTION OF READILY OXYDIZABLE METALS IN A STATE OF HIGH PURITY

This invention relates to improvements in devices for the production of readily oxidizable metals in a state of high purity by electrolysis of molten metal compounds and in particular to an electrolyzer and to a method for the production of lithium in a state of high purity.

The electrolysis of molten metal compounds is frequently carried out in a tank with a graphite anode and an iron cathode. The pure molten metal collects at the surface in free air and consequently oxidizes very rapidly. In the case of lithium, an equiponderant mixture of lithium chloride and potassium chloride is heated in the tank and melts at about 400°C.

Lithium prepared in this manner is not strictly pure since oxides are contained therein from the time of formation and are due to the high affinity of lithium for oxygen with which it is in contact.

The need to obtain pure lithium arises in particular in the field of lithium dry cells and storage batteries and in the nuclear energy in which lithium is an excellent heat-transporting fluid and becomes less corrosive as its purity is higher.

At the present time, the only means of obtaining a metal and especially pure lithium is to distil ordinary commercial lithium but the capital cost entailed in this method is much too high to permit industrial development on a large scale.

The invention is directed to an electrolyzer for molten metal compounds and comprising an electrolytic tank, a cathode welded to the bottom of the tank and surrounding an anode and any known means for carrying out electrolysis, the electrolyzer being distinguished by the fact that the top end of the cathode is surmounted by a collecting chamber rigidly fixed to a cover-plate and provided with a lateral chimney having a recess formed in the top portion of its wall and located at the greatest radial distance from the cathode so as to provide a communication between said chimney and a transfer compartment adapted to communicate at the base thereof with a discharge compartment maintained in an inert atmosphere and provided at the top portion thereof with a chimney which surrounds a metal discharge tube, an expansion chamber containing electrolyte in communication with the electrolyte of the tank and supplied periodically with air by means of a timing system which also controls the level of electrolyte so that it should move down from a top level at which the metal is poured off, at the level of said recess and at the level of said discharge tube, to a bottom level at which it passes from the transfer compartment to the discharge compartment.

The invention is also directed to a method of production of readily oxidizable metal in the pure state, wherein said method essentially consists in collecting in an electrolytic tank the metal formed at the top of the electrode within a collecting chamber, in causing the level of electrolyte to rise to a predetermined top level at which the metal leaves the collecting chamber and is poured into a transfer compartment, in lowering the level of electrolyte to a predetermined bottom level at which the poured metal leaves the transfer compartment and passes to the discharge compartment, in again raising the level of electrolyte to the top level so as to pour it into a discharge tube, in passing a stream of inert gas into the discharge compartment and in discharging the metal to a chamber for treatment in an inert atmosphere in which the metal is converted to ingots in the pure state.

Further properties and advantages of the invention will become apparent from the following description of one exemplified embodiment of an electrolyzer according to the invention, reference being had to the accompanying drawings, wherein.

Figure 1:
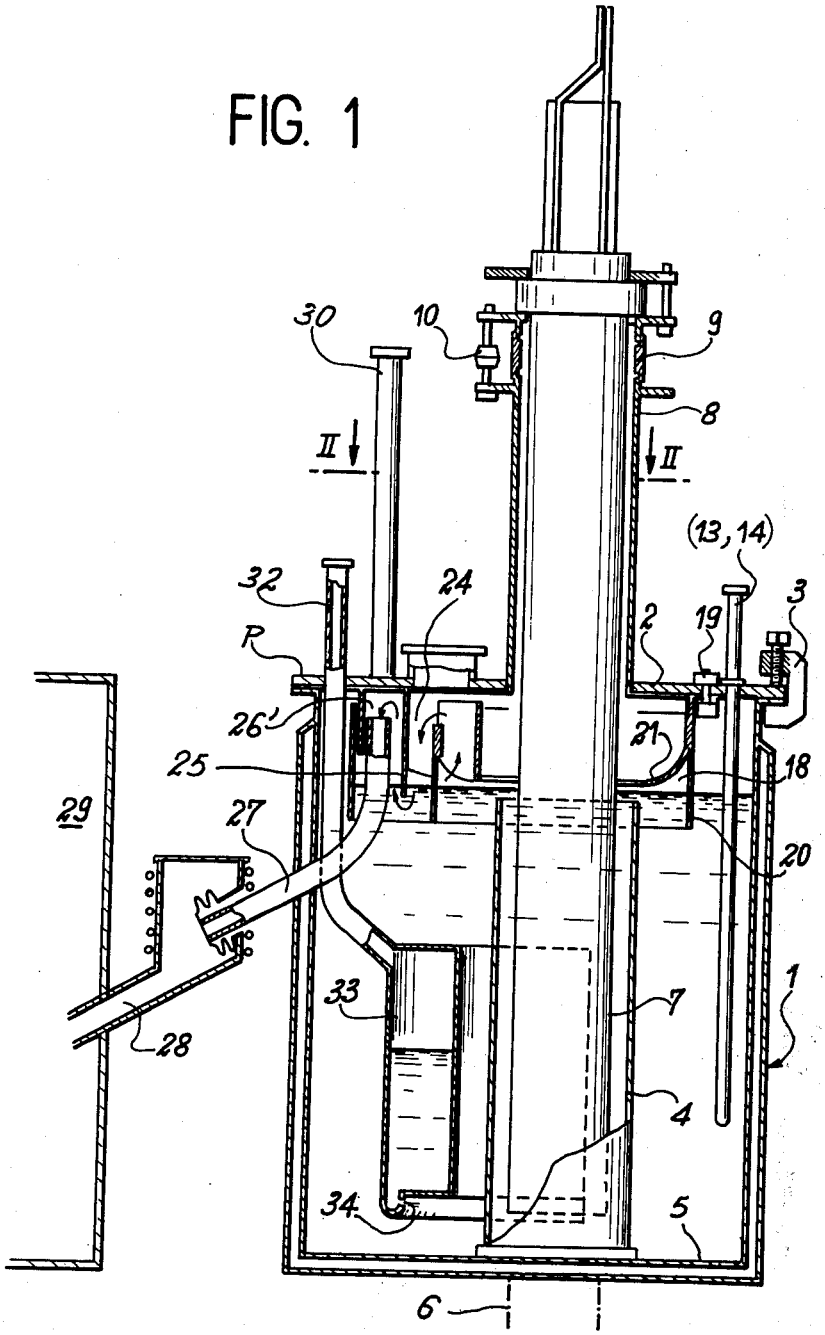
FIG. 1 is a general diagrammatic view of the electrolyzer.

The electrolytic tank 1 shown in FIG. 1 and formed of stainless steel has a double wall and is closed by a cover-plate 2 attached by means of clamps 3. The cylindrical cathode 4 is welded to the bottom wall of the tank and connected to the cathode terminal 6. Orifices (not shown) are formed at the bottom portion of the cathode in order to renew the bath within the cathode zone.

The cylindrical graphite anode 7 is surrounded at the lower end by the cathode 4 and at the upper end by an anode support 8 which is rigidly fixed to the cover-plate 2 and insulated from this latter by a sleeve 9. The anode support 8 is brought to the cathode potential by means of the clamps 3 aforesaid which provide a contact with the tank. Four insulators 10 insulate the anode 7 from the cover-plate 2. A sweeping-air admission tube 11 serves to dilute approximately twenty times the volume of chlorine formed at the surface of the bath and the gas is discharged through the tube 12.

The level of electrolyte is continuously known by means of the probe 13 whereas the pressure is controlled by the probe 14.

The two inspection windows 15 serve to view the bath which is recharged discontinuously through the opening 16. The temperature is controlled by means of the probe 17. Collection of the metal is carried out within an annular chamber 18 which is secured to the cover-plate by means of nuts 19. The chamber 18 comprises a wall 20 in the form of a skirt and a downwardly-extending domical ceiling-plate 21 provided with a lateral chimney 22 having a recess 23 for establishing a communication between said chimney and a transfer compartment 24 which performs the function of lockchamber. It must be pointed out that the compartment 24 terminates in a semi-cylindrical wall 25 which is shorter than the skirt 20 and the compartment 26 is extended upwards by a cylindrical portion 26' which surrounds the upper extremity of the tube 27.

There opens into a discharge compartment 26 which is adjacent to the compartment 24 a tube 27 for discharging the metal towards a downspout 28 and a glove box 29.

Vertically above the compartment 26, a connecting pipe 30 for the admission of argon has its opening at the level of the cover-plate 2 whereas an inspection opening 31 is placed vertically above the compartment 24. In order to admit air into the bath and thus to bring about a change in level of electrolyte, the air is directed through the duct 32 which opens into a semi-annular expansion chamber 33, the base of which is pierced by a number of openings 34 so as to permit the electrolyte to pass from the expansion chamber 33 to the electrolyte of the tank 1 and in the opposite direction.

In order to explain the operation of the electrolyzer, consideration may be given to the moment when the surface of the electrolyte is at its lowest level and when the metal produced in the form of fine particles moves upwards along the cathode and floats at the surface of the bath. A preset timing system controls the admission of air into the duct 32. The electrolyte contained in the chamber 33 is driven towards the tank. The injection of air is stopped as soon as the electrolyte contained in the tank has reached its top level located slightly below the recess 23.

At the time of this operation, the metal is constrained to follow the shape of the chamber 18, is drawn towards the top portion of the skirt 20, rises within the chimney 22 and follows the direction indicated by the arrows.

At the level of the recess 23, the metal overflows into the compartment 24. The pressure within the chamber is then relieved, the level of the bath returns to its bottom level, the metal collected within the collector 24 moves downwards and passes beneath the wall 25 into the compartment 26.

When the timing system initiates a further injection of air, the electrolyte again rises within the tank until it reaches its top level. Within the compartment 26, the metal also rises and passes into the cylindrical portion 26' until it finally overflows into the tube 27 and is conveyed into the glove box 29. By virtue of the compartment 24 which performs the function of a hydraulic seal, a high degree of leak-tightness is achieved between the chlorinated atmosphere of the electrolytic bath and the inert argon atmosphere of the glove box. The metal is therefore discharged without having been permitted to oxidize and its purity is of the order of 99.9 %; the metal is delivered in the form of ingots prepared in a glove box in an inert atmosphere.

Figure 2:
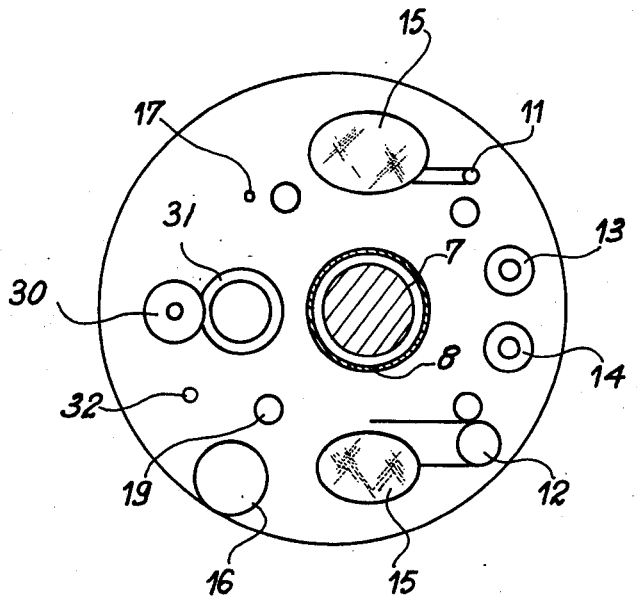
FIG. 2 is a sectional view taken along line II—II of FIG. 1.
Figure 3:
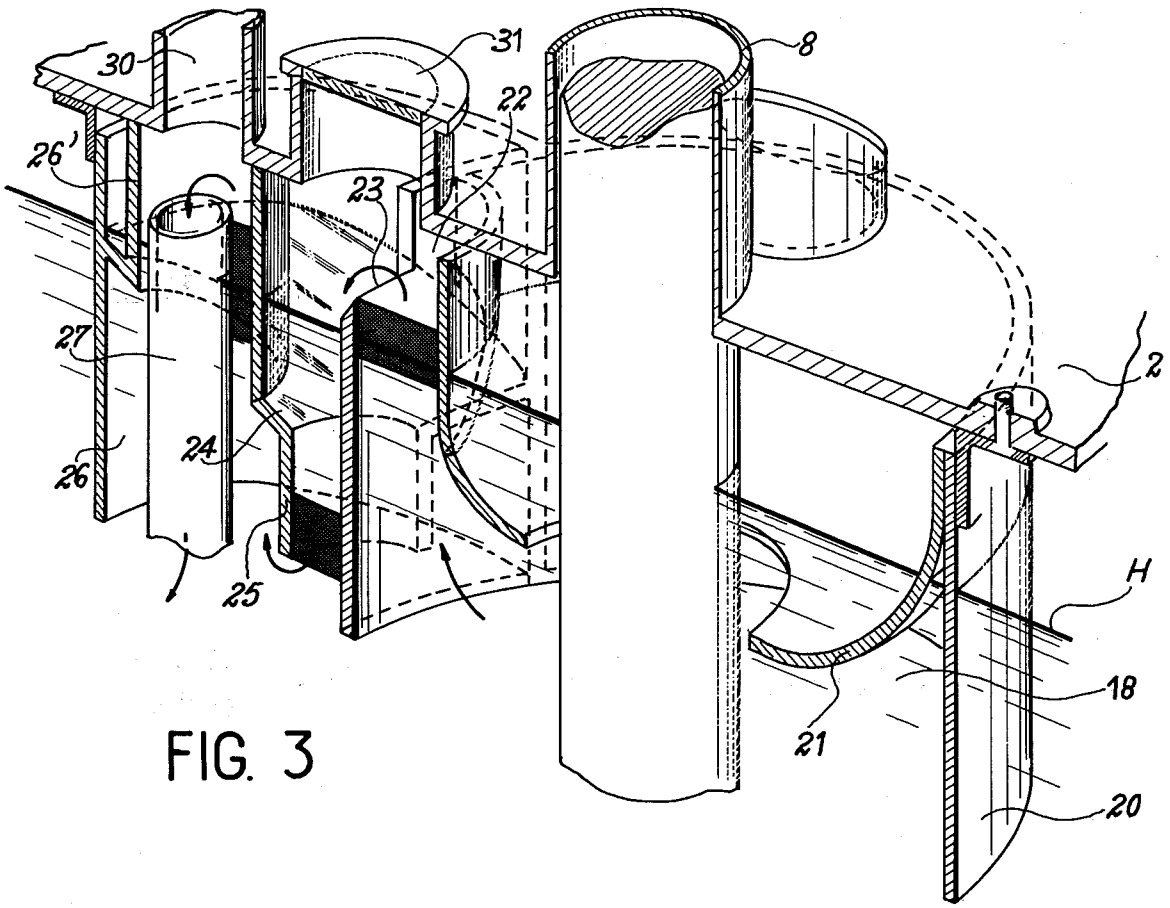
FIG. 3 is a detailed view showing the lockchamber through which the metal is discharged.

The electrolyzer which has just been described with reference to FIGS. 1 to 3 is specially suited to the production of pure lithium by electrolysis of a mixture of lithium chloride and potassium chloride.

We claim:

1. An electrolyzer for molten metal compounds for the preparation of readily oxidizable metals having a high degree of purity and comprising an electrolytic tank, a cathode welded to the bottom of said tank and surrounding a vertical anode and any known means for carrying out electrolysis, wherein the top end of the cathode is surmounted by a collecting chamber rigidly fixed to a coverplate and provided with a lateral chimney having a recess formed in the top portion of its wall and located at the greatest radial distance from the cathode so as to establish a communication between said chimney and a transfer compartment adapted to communicate at the base thereof with a discharge compartment maintained in an inert atmosphere and provided at the top portion thereof with a chimney which surrounds a metal discharge tube, an expansion chamber containing electrolyte in communication with the electrolyte of the tank and supplied periodically with air by a timing system which also controls the level of electrolyte so that it should move down from a top level at which the metal is poured-off at the level of said recess and at the level of said discharge tube, to a bottom level at which said metal passes from the transfer compartment to the discharge compartment.

2. An electrolyzer according to claim 1, wherein the collecting chamber which is secured to the cover-plate has a lateral wall in the form of a skirt and a downwardly-extending domical ceiling-plate provided with a lateral chimney in which is formed a recess.

3. An electrolyzer according to claim 1, wherein the expansion chamber of semi-annular shape is connected at the upper end thereof to an air admission duct and provided with openings in the bottom wall thereof.

4. An electrolyzer according to claim 1, wherein the discharge compartment communicates at the upper end thereof with a tube for the admission of inert gas.

5. An electrolyzer according to claim 1, wherein pure lithium is prepared by treatment within the electrolytic tank of an equiponderant mixture of lithium chloride and potassium chloride.

* * * * *